US005093853A

United States Patent [19]

Licht et al.

[11] Patent Number: 5,093,853

[45] Date of Patent: Mar. 3, 1992

[54] X-RAY DEVICE

[75] Inventors: Georg Licht, Hamburg; Helmut Kiesow, Quickborn, both of Fed. Rep. of Germany

[73] Assignee: U.S. Philips Corporation, New York, N.Y.

[21] Appl. No.: 578,047

[22] Filed: Sep. 5, 1990

[30] Foreign Application Priority Data

Sep. 5, 1989 [DE] Fed. Rep. of Germany ..... 3929402

[51] Int. Cl.[5] ..... H05G 1/54

[52] U.S. Cl. ..... 378/117; 378/101; 378/118

[58] Field of Search ..... 361/111, 54, 56, 86.91; 378/114, 117, 118, 101

[56] References Cited

U.S. PATENT DOCUMENTS

| | | | |
|---|---|---|---|
| 2,976,462 | 3/1961 | Miller | 361/54 |
| 4,190,873 | 2/1980 | Klokkers | 361/56 |
| 4,333,011 | 6/1982 | Mester | 378/110 |
| 5,008,912 | 4/1991 | Farrall et al. | 378/101 |

*Primary Examiner*—Janice A. Howell
*Assistant Examiner*—Don Wong
*Attorney, Agent, or Firm*—William Squire

[57] ABSTRACT

A high-voltage generator supplies an X-ray source with a high-voltage via at least one high-voltage cable. To protect the X-ray tube of the source against destruction by discharge phenomena in the X-ray tube, a damping impedance which is operative only from a high-frequency point of view is provided at the output of the high-voltage generator.

1 Claim, 1 Drawing Sheet

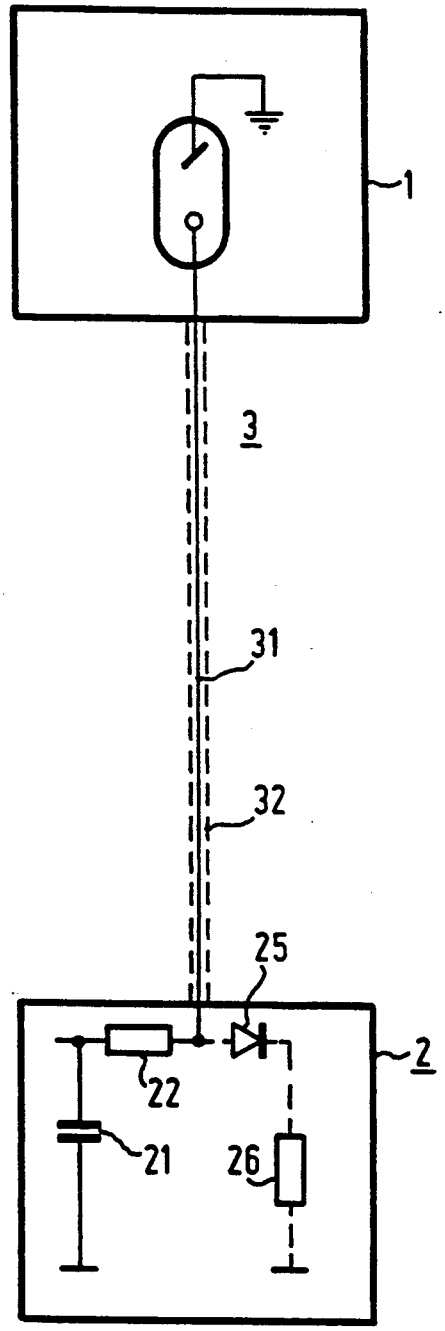
1
3
31
32
25
2
22
21
26

X-RAY DEVICE

BACKGROUND OF THE INVENTION

FIELD OF THE INVENTION

The invention relates to an X-ray device, comprising an X-ray source and a high-voltage generator for supplying the X-ray source with a high voltage via at least one high-voltage cable. X-ray devices of this kind are generally known.

DESCRIPTION OF THE PRIOR ART

Disruptions inevitably occur during operation of the X-ray tube in practice. During such disruptions charge carrier avalanches occur inside the X-ray tube, causing arcthrough of the X-ray tube, the energy stored in the capacitances of the high-voltage cable then being shock-wise discharged across the X-ray tube. The X-ray current may then temporarily reach values in the kA range, so that there is a risk of damaging of the X-ray tube. This risk is more pronounced as the high-voltage cable is longer or, in the case of two high-voltage cables between the high-voltage generator and the X-ray source, as the high-voltage cables are longer, and as the operating voltage of the X-ray tube is higher.

SUMMARY OF THE INVENTION

It is an object of the invention to reduce the risk of damaging of the X-ray tube. This object is achieved in accordance with the invention in that parallel to the output of the high-voltage generator there is connected a series connection of a diode which is not conductive during normal operation and a damping resistor whose resistance is in the order of magnitude of the characteristic impedance of the cable.

The invention is based on the recognition of the fact that the X-ray tube abruptly shortcircuits the high-voltage cable in the case of such a disruption, so that in the cable an oscillation is generated which is only slightly damped. A cable which is shortcircuited at one end acts as a parallel resonant circuit. The cable length then corresponds to one quarter of the wavelength. The resonant frequency is equal to signal velocity divided by four times the cable length.

After a shortcircuit in the X-ray tube, the cable is discharged via the tube and is subsequently charged again with reversed polarity. The diode which is blocked in the normal condition then becomes conductive and the cable is terminated by the resistor, which situation corresponds to a strongly damped resonant circuit. The energy of the cable is essentially converted into heat in the terminating resistor. It is advantageous when the diode is not a very fast diode, so that it can conduct also during the negative going halfwave.

The invention will be described in detail in the drawings hereinafter with reference to the drawing. Therein:

To sole FIGURE shows an X-ray device in accordance with the invention.

DESCRIPTION OF THE PREFERRED EMBODIMENT

The figure shows an X-ray source 1. The anode of the X-ray tube forming part of this source is grounded, its cathode operating with a negative high voltage of, for example 225 kV. This voltage is supplied by an X-ray generator 2. The high voltage, generated in the high-voltage generator in a manner not shown, generally is available from a smoothing capacitor 21. The high-voltage generator 2 is connected to the X-ray source 1 via a high-voltage cable 3 comprising three inner conductors 31, only one of which is shown in FIG. 1, which conductors carry substantially the same high-voltage potential (the slight voltage differences between these inner conductors serve to generate a filament current in the two filaments of the cathode). In addition, the high-voltage cable comprises in known manner a grounded gauze 32, preferably of copper, which encloses the inner conductors 31. The high voltage across the capacitor 21 is not directly applied to the inner conductor 31 of the high-voltage cable 3 connected to the cathode, but via an output resistor 22 of, for example 100 kΩ. This output resistor serves to limit the current flowing through the generator in the case of a shortcircuit.

In the case of a disruption in the X-ray tube, the latter forms substantially a shortcircuit for the high-voltage cable and the cable capacitances are discharged via the X-ray tube, the discharge currents being in the kA range. Because of the cable inductances, an oscillation occurs whose voltage maximum is situated on the output of the high-voltage generator. This oscillation is damped in order to reduce its energy and hence also the risk of damaging of the X-ray source 1.

In order to damp the oscillation of the high-voltage cable, the series connection of a diode 25 and a resistor 26 is connected to the output of the high-voltage generator 2. The value of the resistor 26 must at least be in the order of magnitude of the characteristic impedance of the high-voltage cable and the polarity of the diode 25 must be such that it is blocked by the high voltage prevailing during normal operation. In the case of a disruption in the X-ray tube, an oscillation occurs on the output of the high-voltage generator 2, the polarity of the high voltage on the output of the high-voltage generator then being reversed in accordance with the self-resonance of the high-voltage cable. When the polarity has been reversed, the oscillation current always flows via the resistor 26 so that it is damped. The load impedance formed by the series connection 25 and 26 is thus operative from a high-frequency point of view only. This solution requires a diode (or a number of series connected diodes) whose reverse voltage corresponds to the high voltage of the X-ray generator and which must be capable of withstanding the strong current through the X-ray tube in the case of a disruption.

What is claimed is:

1. An X-ray device, comprising:

an X-ray source;

a high-voltage generator having an output for supplying the X-ray source with a high voltage via at least one high-voltage cable; and a series connection of a diode which is not conductive during normal operation of the source and a damping resistor whose resistance is in the order of magnitude of the characteristic impedance of the cable connected in parallel to the output of the high-voltage generator.

* * * * *